US007526217B2

(12) United States Patent
Takiguchi et al.

(10) Patent No.: US 7,526,217 B2
(45) Date of Patent: Apr. 28, 2009

(54) IMAGE FORMING APPARATUS AND WASTE TONER WARNING METHOD

(75) Inventors: Toshiki Takiguchi, Yamatokoriyama (JP); Kazuhiro Matsuyama, Ikoma (JP); Hirokazu Yamauchi, Uji (JP); Hiroyuki Murai, Yamatokoriyama (JP); Yuji Kumagai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 231 days.

(21) Appl. No.: 11/524,313

(22) Filed: Sep. 21, 2006

(65) Prior Publication Data

US 2007/0065166 A1 Mar. 22, 2007

(30) Foreign Application Priority Data

Sep. 21, 2005 (JP) ..... 2005-274291

(51) Int. Cl.
*G03G 21/12* (2006.01)

(52) U.S. Cl. ..... 399/35; 399/81

(58) Field of Classification Search ..... 399/9, 399/24, 25, 27, 34, 35, 75, 81
See application file for complete search history.

(56) References Cited

U.S. PATENT DOCUMENTS 5,790,917 A * 8/1998 Takura et al. ..... 399/27
5,794,094 A * 8/1998 Boockholdt et al. ..... 399/27
6,505,009 B2 * 1/2003 Henricus et al. ..... 399/35

FOREIGN PATENT DOCUMENTS

JP 09-212052 8/1997
JP 2002-139971 5/2002

* cited by examiner

*Primary Examiner*—Hoan H Tran
(74) *Attorney, Agent, or Firm*—Nixon & Vanderhye P.C.

(57) ABSTRACT

An image forming apparatus for executing image forming process on a page by page basis including: a toner image forming section for producing a visible image formed of toner as a toner image on an image carrier; a transfer section which performs a transfer process for transferring the formed toner image onto a recording medium; a cleaning section which removes toner remaining on the image carrier after the transfer process; a waste toner storing section in which the removed toner is accumulated; and a waste toner amount detecting section which detects an amount of the toner accumulated in the waste toner storing section on the basis of at least three detection levels.

19 Claims, 6 Drawing Sheets

IMAGE FORMING APPARATUS AND WASTE TONER WARNING METHOD

CROSS-REFERENCE TO RELATED APPLICATION

This application is related to Japanese Patent Application No. 2005-274291 filed on Sep. 21, 2005, whose priority is claimed and the disclosure of which is incorporated by reference in its entirety.

BACKGROUND

1. Field

The disclosed technology relates to an image forming apparatus and a waste toner warning method and, more specifically, to an image forming apparatus and a waste toner warning method which are adapted to detect the amount of waste toner accumulated in a waste toner storing section and/or to provide a warning on the basis of the detection.

2. Description of the Related Art

Image forming apparatuses are conventionally known which are adapted to output an image by forming an electrostatic latent image on an image carrier, then developing the electrostatic latent image into a toner image with a toner, and transferring the toner image onto a recording medium. One example of such image forming apparatuses is an electrophotographic multifunction peripheral. In the image forming apparatus, the toner slightly remains on the image carrier after the toner image is transferred onto the recording medium. Therefore, the remaining toner is removed in a cleaning section before the next electrostatic latent image is formed on the image carrier. The removed toner is electrically charged, and contaminated with paper dust and the like. This makes it impossible to reuse the toner. Therefore, the removed toner is stored as a waste toner in a dedicated container and, before the container is filled to capacity, the waste toner stored in the container is discarded. Further, the container is typically detachable for replacement, so that the waste toner can be easily discarded with the container.

The amount of the waste toner to be removed is dependent upon the patterns and sizes of images to be formed and the state of the image carrier. Therefore, a detection mechanism is typically provided for detecting the full capacity state of the waste toner container. A conventionally known example of the detection mechanism is adapted to detect the weight of the container in which the waste toner is accumulated and, when the weight of the container reaches a predetermined level, provides a warning for prompting a user to discard the waste toner (see, for example, Japanese Unexamined Patent Publication No. HEI09(1998)-212052).

In a conventional waste toner detection method and a warning method based on the waste toner detection method, the discard of the waste toner is requested in the following manner when the full capacity state of the waste toner container is detected during a sequence of printing jobs. For example, the printing job sequence is interrupted to request the discard of the waste toner after a current printing job is completed. Alternatively, the discard of the waste toner is requested after the printing job sequence is completed. In a so-called high speed image forming apparatus adapted for a large volume printing process, however, a great number of pages might be printed before the completion of the printing job sequence after the detection of the full capacity state of the waste toner container. To cope with such a case, a greater margin may be provided for the detection of the full capacity state of the waste toner container. However, if small volume printing jobs are sequentially performed, the warning is provided even with the waste toner container having a sufficient residual capacity for storing the waste toner. On the other hand, the high speed image forming apparatus, which is expected to efficiently perform the printing process, is increasingly required to avoid the interruption of the job sequence as much as possible for reduction of downtime. In this connection, it is unreasonable to interrupt the job sequence for the discard of the waste toner, so that the replacement of the container is requested before the start of the job sequence.

Further, the waste toner container for the high speed image forming apparatus has a greater volume for reducing the frequency of the discard of the waste toner. For example, the container is capable of storing about 5 kg of waste toner in the full capacity state. Where the conventional detection mechanism adapted to detect the weight is employed for the high speed image forming apparatus, the greater capacity container suffers from a greater detection error than a smaller capacity container.

For the reduction of the downtime, the image forming apparatus is required to provide the warning for requesting the discard of the waste toner when the user performs any other operation on the image forming apparatus.

Hence, there is a demand for a method for predicting the full capacity state of the waste toner container so as to avoid the interruption of the printing job sequence, a method for accurately detecting the full capacity state of the waste toner container for the reduction of the frequency of the discard of the waste toner, and/or a detection method which makes it possible to provide a warning for the reduction of the downtime.

SUMMARY

According to one aspect of the present invention, an image forming apparatus is provided for executing image forming process on a page by page basis including: a toner image forming section for producing a visible image formed of toner as a toner image on an image carrier; a transfer section which performs a transfer process for transferring the formed toner image onto a recording medium; a cleaning section which removes toner remaining on the image carrier after the transfer process; a waste toner storing section in which the removed toner is accumulated; and a waste toner amount detecting section which detects an amount of the toner accumulated in the waste toner storing section on the basis of at least three detection levels.

According to another aspect of the present invention, a waste toner warning method is provided, for use in an image forming apparatus for executing image forming process on a page by page basis including a developing section which produces a visible image formed of toner as a toner image on an image carrier, a transfer section which performs a transfer process for transferring the formed toner image onto a recording medium, a cleaning section which removes toner remaining on the image carrier after the transfer process, and a waste toner storing section in which the removed toner is accumulated, for providing a warning on the basis of detection of an amount of the toner accumulated in the waste toner storing section, the method including: detecting the amount of the accumulated toner on the basis of at least three detection levels; before an image forming process is started, estimating an amount of the toner to be accumulated in the waste toner storing section during the image forming process; and if it is predicted that the waste toner storing section becomes full during the image forming process after the start of the image forming process on the basis of the estimated toner amount and a detection result obtained in the toner amount detecting step, providing a warning for requesting discard of the waste toner before the start of the image forming process.

DETAILED DESCRIPTION

Figure 1:
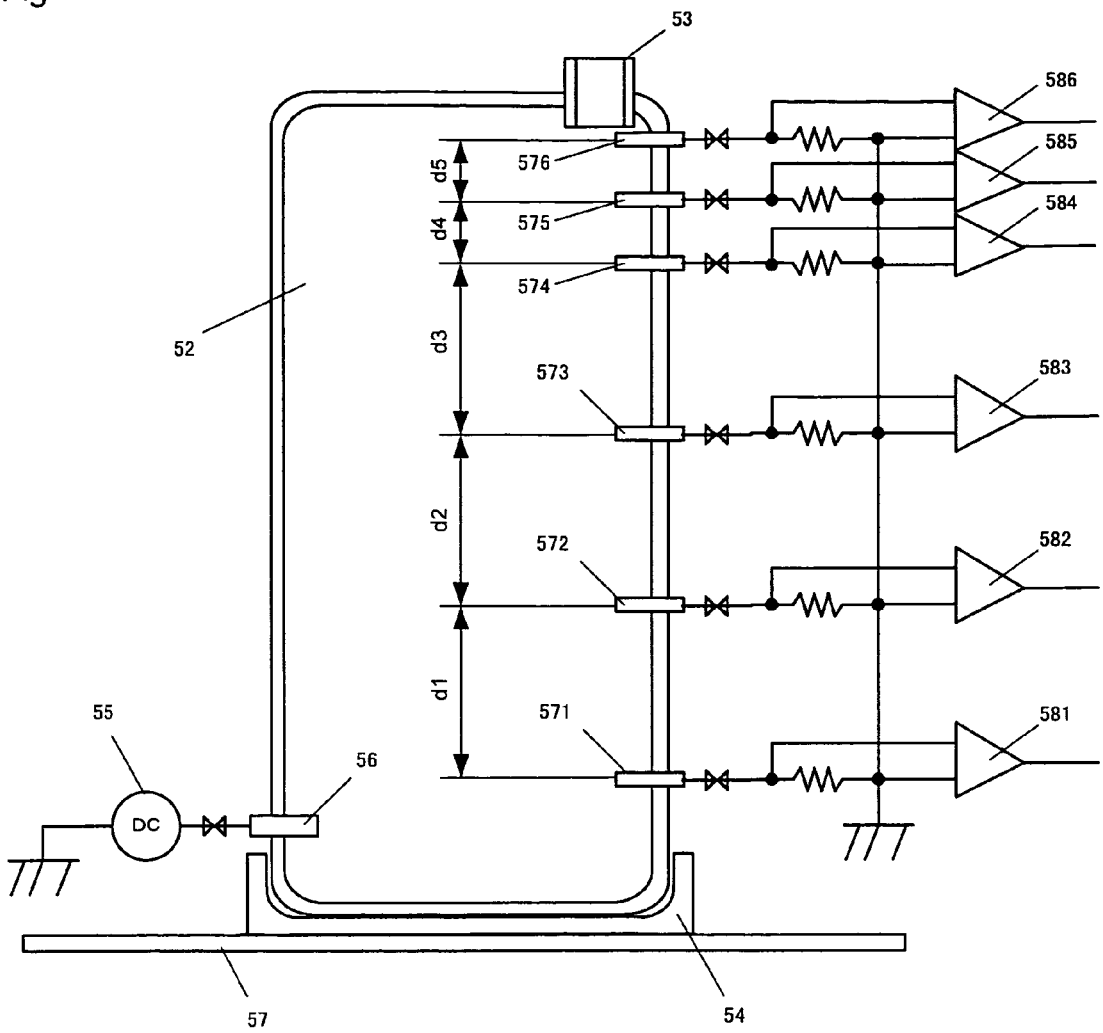
FIG. 1 is an explanatory diagram according to an embodiment of the present invention illustrating in detail a waste toner container and a waste toner detecting section for an image forming apparatus shown in FIG. 3.

Since the image forming apparatus includes the waste toner amount detecting section which detects an amount of the toner accumulated in the waste toner storing section on the basis of at least three detection levels, even if a smaller amount of waste toner is accumulated in the waste toner storing section before a large volume printing job is started, the detection of the waste toner amount makes it possible to predict that the waste toner storing section becomes full during the printing job. Further, interruption of the printing job can be avoided by preliminarily providing the warning on the basis of the prediction.

Further, the waste toner amount can be accurately detected by selecting the number of the detection levels according to an accuracy requirement. The accurate detection of the waste toner amount makes it possible to reduce a detection error and to provide a warning when the waste toner is accumulated to a near capacity level. Therefore, the frequency of the discard of the waste toner can be reduced.

The detection of the near capacity state of the waste toner storing section makes it possible to provide the warning for the discard of the waste toner accumulated to the near capacity level when the user performs any other operation on the image forming apparatus. Thus, the downtime can be reduced.

Since the example warning method includes detecting the amount of the accumulated toner on the basis of at least three detection levels, even if a smaller amount of waste toner is accumulated in the waste toner storing section before the large volume printing job is started, the detection of the waste toner amount makes it possible to predict that the waste toner storing section becomes full during the printing job. Further, the interruption of the printing job can be avoided by preliminarily providing the warning on the basis of the prediction.

In an image forming apparatus embodiment, intervals between the detection levels for the detection of the accumulated toner amount by the waste toner amount detecting section may be defined by at least two different values, and an interval between detection levels for the detection of greater toner amounts may be smaller than an interval between detection levels for the detection of smaller toner amounts. When the waste toner is accumulated to the near capacity level, the waste toner amount is more accurately detected. Thus, the warning and the interruption of the printing job can be achieved on the basis of the more accurate detection. Therefore, clogging of a transport path extending from the cleaning section is prevented, which may otherwise occur when the waste toner is accumulated to the full capacity level. On the other hand, where the amount of the accumulated waste toner is smaller, the construction of the waste toner amount detecting section may be simplified without provision of a greater number of the detection levels than required. As described above, the amount of the waste toner to be removed is varied depending upon the patterns and sizes of the images and other conditions, so that the accuracy of the prediction is not high. Therefore, even if the waste toner amount is accurately detected when the waste toner storing section has a sufficient residual capacity, a greater detection error occurs, making it impossible to provide results corresponding to the detection accuracy.

In the image forming apparatus, the waste toner amount detecting section may include: an energization electrode provided at a height lower than a height associated with the lowest detection level in the waste toner storing section; a plurality of detection electrodes respectively provided at heights associated with the detection levels in opposed relation to the energization electrode in the waste toner storing section; a detection power source which applies a predetermined voltage between the energization electrode and each of the detection electrodes; and an electrode current detecting section which, when the toner is accumulated to a level higher than each of the detection electrodes, detects an electric current flowing between the detection electrode and the energization electrode through the toner. Thus, the detection of the waste toner amount can be achieved with a simple construction including the electrodes and the power source.

The image forming apparatus may further comprise a printing page number acquiring section which acquires a number of pages to be printed through the image forming process before the image forming process is started; a waste toner amount estimating section which estimates an amount of the toner to be accumulated in the waste toner storing section during the image forming process; and a warning controlling section which, if it is predicted that the waste toner storing section becomes full during the image forming process after the start of the image forming process on the basis of the estimated toner amount and the toner amount detected by the waste toner amount detecting section, provides a warning for requesting discard of the waste toner before start of a printing operation in the image forming process.

In the image forming apparatus, the waste toner estimating section may determine a waste toner amount per page on the basis of a number of pages previously printed by the image transfer in the transfer section and a history of the toner amount previously detected by the waste toner amount detecting section, and may estimate the amount of the toner to be accumulated in the waste toner storing section during the image forming process on the basis of the determined waste toner amount per page and the number of the pages to be printed through the image forming process. Thus, the amount of the waste toner to be accumulated in the waste toner storing section can be accurately estimated on the basis of the history.

The image forming apparatus may further comprise a warning controlling section which, when the waste toner amount detecting section determines that the toner accumulated in the waste toner storing section reaches the highest detection level or a level lower by a predetermined amount than the highest detection level, provides a warning for requesting discard of the waste toner in response to an operation performed on the image forming apparatus by a user. Thus, the warning can be provided to prompt the user to discard the waste toner, when the user is present in the vicinity of the image forming apparatus to operate the image forming apparatus.

The image forming apparatus may further comprise an operation panel for inputting a command for starting a copier image forming process, wherein the warning controlling section provides the warning in response to the input of the command for staring the image forming process via the operation panel.

The image forming apparatus may further comprise an operation panel for inputting a command for starting a facsimile transmitting process, wherein the warning controlling section provides the warning in response to the input of the command for starting the facsimile transmitting process via the operation panel.

The image forming apparatus may further comprise a recording medium outputting section which outputs the recording medium outside the apparatus after the image transfer; a recording medium receiving section which receives the outputted recording medium; and a recording medium removal detecting section which detects removal of the recording medium from the recording medium receiving section by the user; wherein the warning controlling section provides the warning in response to the detection of the removal of the recording medium by the recording medium removal detecting section as the operation.

The image forming apparatus may further comprise a recording medium feeding section which feeds the recording medium to the transfer section; a recording medium feed tray which accommodates recording media to be fed; and a recording medium replenishment detecting section which detects replenishment of the recording medium feed tray with recording media by the user; wherein the warning controlling section provides the warning in response to the detection of the replenishment of the recording medium feed tray with the recording media by the recording medium replenishment detecting section as the operation.

The image forming apparatus may further comprise a warning controlling section which, when the waste toner amount detecting section determines that the toner is accumulated to a full capacity level or a near capacity level in the waste toner storing section, provides a warning for requesting discard of the waste toner in response to an event which requires a user to perform an operation on the image forming apparatus. Thus, when the event requiring the user to perform the operation on the image forming apparatus occurs and the user is expected to perform the operation to cope with the event, the warning is provided to prompt the user to discard the waste toner.

The image forming apparatus may further comprise a jam detecting section which detects a jam of the recording medium, wherein the warning controlling section provides the warning in response to the detection of the jam by the jam detecting section as the event.

The image forming apparatus may further comprise a recording medium feeding section which feeds the recording medium to the transfer section; a recording medium feed tray which accommodates recording media to be fed; and an emptiness detecting section which detects emptiness of the recording medium feed tray; wherein the warning controlling section provides the warning in response to the detection of the emptiness of the recording media feed tray by the emptiness detecting section as the event.

The image forming apparatus may further comprise a recording medium outputting section which outputs the recording medium after the image transfer; a recording medium receiving section which receives the outputted recording medium; and a full capacity state detecting section which detects a full capacity state of the recording medium receiving section; wherein the warning controlling section provides the warning in response to the detection of the full capacity state of the recording medium receiving section by the full capacity state detecting section as the event.

The embodiments will hereinafter be described in greater detail with reference to the attached drawings. The invention will be best understood from the following description. It should be understood that the following description is illustrative of the invention in all aspects, but not limitative of the invention.

Construction of Image Forming Apparatus

Figure 3:
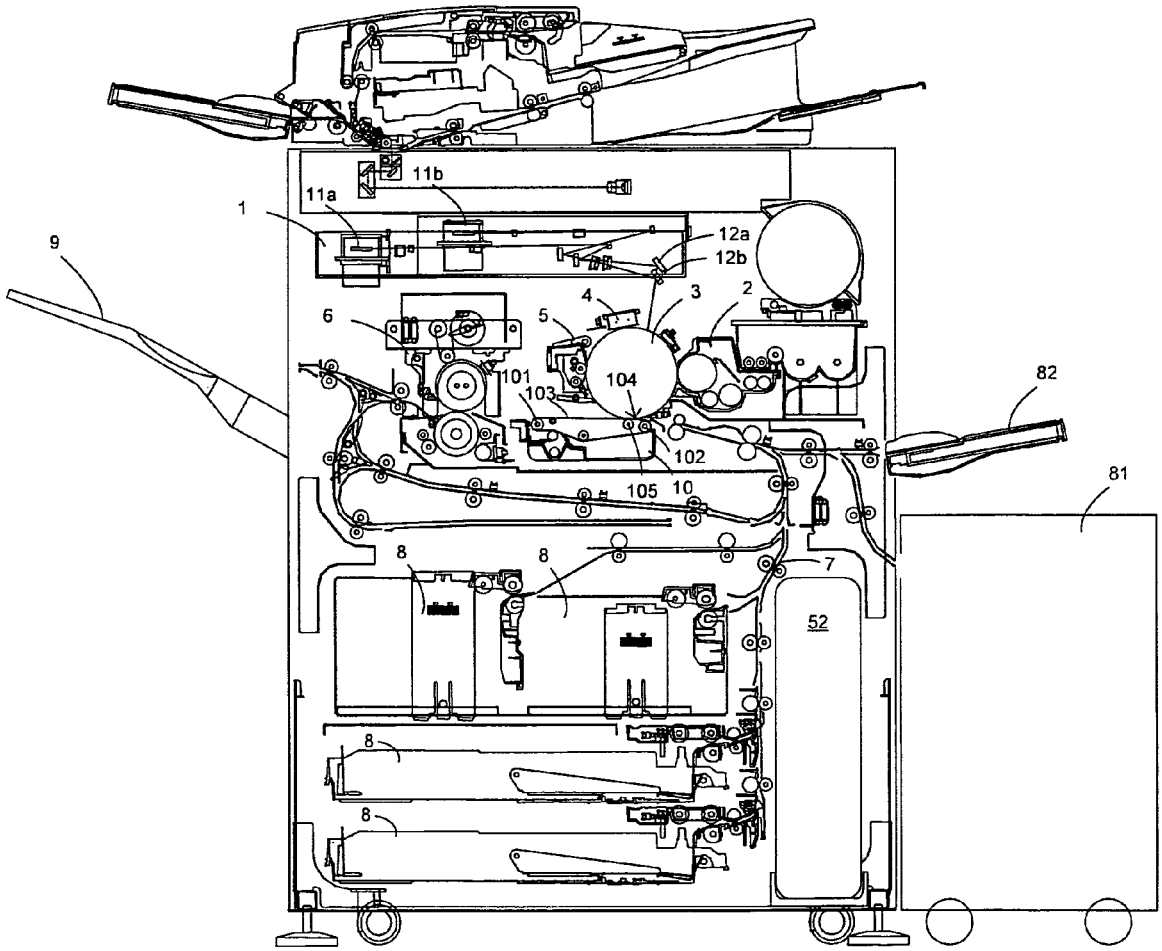
FIG. 3 is an explanatory diagram illustrating the construction of the image forming apparatus according to an embodiment of the present invention.

FIG. 3 is an explanatory diagram illustrating the construction of an image forming apparatus according to an embodiment.

The image forming apparatus is adapted to form a monochrome image on a predetermined sheet (recording medium) according to image data transmitted from the outside. As shown, the image forming apparatus includes an exposure unit 1, a developing unit 2, a photoconductor drum 3, an charging unit 4, a cleaner unit 5, a fixing unit 6, a sheet transport path 7, sheet feeding trays 8, a sheet receiving tray 9 and the like.

The charging unit 4 is electrifying means for evenly electrically charging the surface of the photoconductor drum 3 at a predetermined potential. The charging unit 4 is of a charger type as shown in FIG. 3. However, an electrifying roller or an electrifying brush of contact type may be used as the charging unit 4.

The exposure unit 1 is a laser scanning unit (LSU) which includes a laser emitting section 11*a*, 11*b* and reflection mirrors 12*a*, 12*b* as shown in FIG. 3. Alternatively, an EL or LED writing head may be employed, in which light emitting elements are arranged in an array. The apparatus utilizes a plurality of laser beams to perform a high speed printing process. More specifically, the apparatus employs a two-beam method for suppressing excessive increase in light emitting speed. The surface of the photoconductor drum 3 evenly charged by the charging unit 4 is exposed to light by the exposure unit 1 according to the inputted image data, whereby an electrostatic latent image is formed on the surface of the photoconductor drum 3 according to the image data.

The developing unit 2 (developing section) is adapted to develop the electrostatic latent image formed on the photoconductor drum 3 into a toner image with a black toner.

The cleaner unit 5 is adapted to remove the toner remaining on the surface of the photoconductor drum 3 after the development and transfer of the toner image. The removed toner (waste toner) passes through a waste toner transport path 51 (see FIG. 2 to be referred to later), and is accumulated in a waste toner container 52.

The waste toner container 52 (waste toner storing section) has a waste toner detecting section for detecting the amount of the waste toner accumulated in the waste toner container 52, and is detachable from an image forming apparatus body. The waste toner container 52 is inserted from a front side to an innermost position of the image forming apparatus and, in this position, receives and stores waste toner falling from an end of the waste toner transport path 51. A detection signal of the waste toner detecting section is applied to terminals of a connector (not shown) attached to a rear side wall of the waste toner container 52. When the waste toner container 52 is inserted in the image forming apparatus body, the terminals are engaged with terminals of a connector provided on the side of the image forming apparatus. The detection signal is applied to a control board (not shown) through the terminals of the connector. The control board controls operations of the image forming apparatus. Further, the control board detects the amount of the waste toner accumulated in the waste toner container 52 on the basis of the signal from the waste toner detecting section, and displays a warning message on a display section of an operation panel (not shown) according to the detected waste toner amount for prompting a user to replace the waste toner container 52.

The control board includes a microprocessor, a ROM, a RAM, a nonvolatile memory, an input circuit and an output circuit. The ROM stores control programs to be executed by a CPU. The RAM provides a work area for the CPU. The nonvolatile memory retains control data. The input circuit receives signals inputted from various detecting means including the waste toner detecting section in the image forming apparatus. The output circuit drives actuators and motors for operating mechanisms provided in the image forming apparatus and loads such as the laser emitting section 11*a*, 11*b*.

The toner image formed on the photoconductor drum 3 through the development by the developing unit 2 is transferred onto a sheet by a transfer mechanism 10 (a transfer belt unit in this apparatus). The transfer mechanism 10 applies an electric field of a polarity opposite from the polarity of the charges of the electrostatic latent image to a back side of the sheet. Thus, the toner image is transferred onto the sheet from the photoconductor drum 3. Where the toner image has negative charges, for example, positive charges are applied by the transfer mechanism 10.

In the apparatus, the transfer mechanism 10 includes a transfer belt 103 having a predetermined resistivity ($1\times10^{9}$ to $1\times10^{13}\Omega\cdot$cm) and entrained around a driving roller 101, a driven roller 102 and other rollers. The transfer mechanism 10 further includes an electrically conductive elastic roller 105 provided at a contact 104 between the photoconductor drum 3 and the transfer belt 103 and having conductivity different from that of the driving and driven rollers. The electrically conductive elastic roller 105 is capable of applying a transfer electric field. The sheet formed with the toner image (unfixed toner) transferred by the transfer mechanism 10 is transported into the fixing unit 6, in which the unfixed toner is fused and fixed onto the sheet.

The fixing unit 6 includes a heat roller and a pressure roller. A sheet separation claw, a roller surface temperature detecting device (thermistor) and a roller surface cleaning member are disposed around the heat roller. A heat source (heater) for keeping the surface of the heat roller at a predetermined temperature (a fixing temperature of about 160 to 200° C.) is provided inside the heat roller. The transported sheet is brought into press contact between the heat roller and the pressure roller. At a press contact position, the unfixed toner on the sheet is brought into contact with the surface of the heat roller thereby to be fused by the heat of the heat roller and, at the same time, fixed onto the sheet by a pressure applied by the heat roller and the pressure roller.

The sheet feeding trays 8 each store sheets (recording mediums) to be used for the image formation. In the apparatus, the sheet feeding trays 8 are disposed below the image forming section and on a right side of the image forming apparatus. For a high speed printing process, the sheet feeding trays 8 are capable of storing a great number of sheets. More specifically, the sheet feeding trays 8 disposed below the image forming section are each capable of storing 500 to 1500 sheets. A large volume sheet cassette 81 capable of storing a greater number of sheets than the sheet feeding trays 8 and a manual sheet feeding tray 82 to be used for printing on any of various types of sheets such as having odd sizes are provided on a lateral side of the apparatus.

The sheet receiving tray 9 is disposed on a side of the apparatus opposite from the manual sheet feeding tray 82. A finishing device for performing finishing operations (such as stapling and punching operations) on outputted sheets and a plurality of sheet receiving trays may be optionally provided instead of the sheet receiving tray 9.

Figure 2:
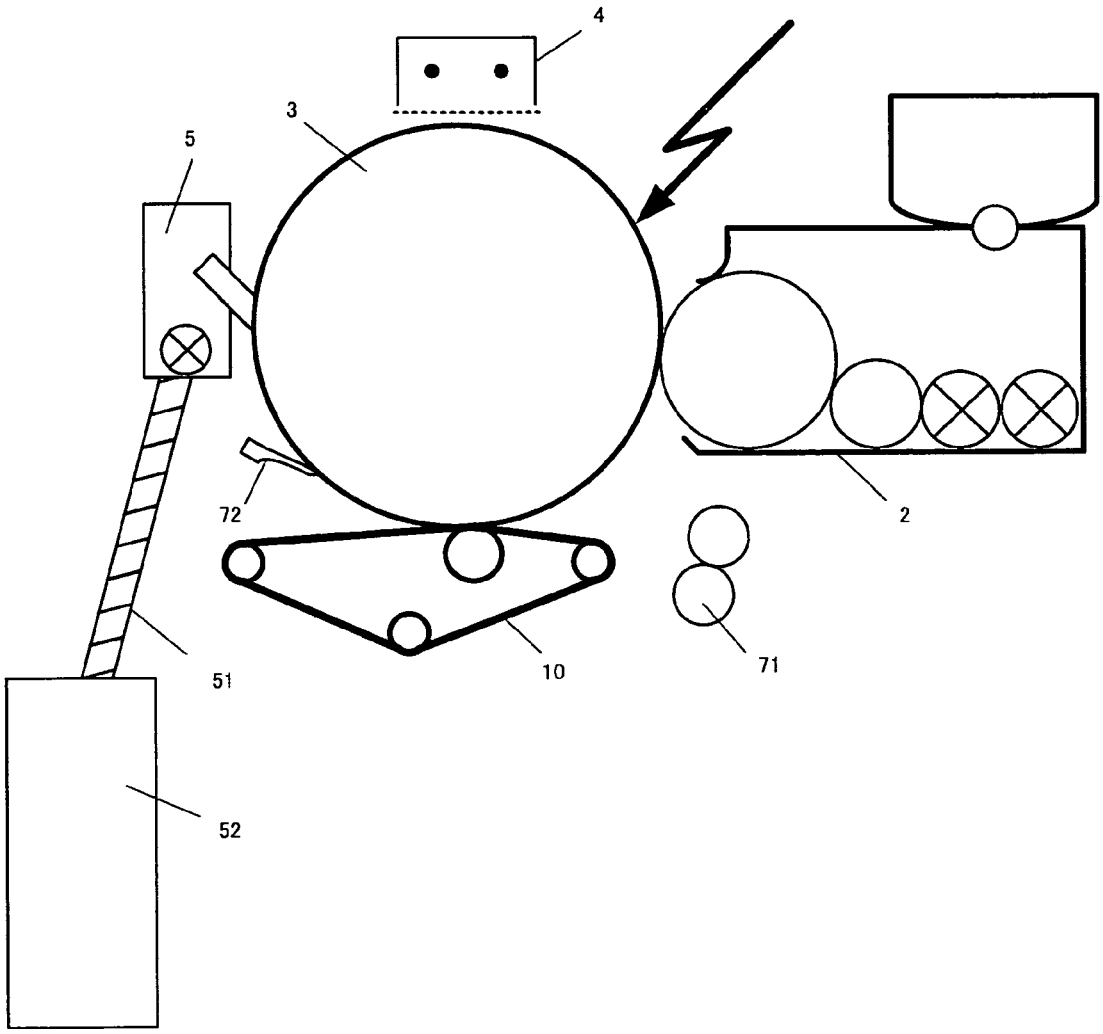
FIG. 2 is an explanatory diagram according to an embodiment of the present invention schematically illustrating components disposed around a photoconductor drum for image formation in the image forming apparatus shown in FIG. 3.

FIG. 2 is an explanatory diagram schematically illustrating components disposed around the photoconductor drum 3 for the image formation in the image forming apparatus shown in FIG. 3. In FIG. 2, the waste toner container 52 is illustrated as being disposed on the left side of the cleaner unit 5 for clarity. In reality, the waste toner container 52 is disposed on the right side of the sheet feeding trays 8 in the image forming apparatus shown in FIG. 3, and the waste toner transport path 51 is disposed between the cleaner unit 5 and the waste toner container 52 in a rear portion (not shown) of the image forming apparatus shown in FIG. 3.

Constructions of Waste Toner Container and Waste Toner Amount Detecting Section

FIG. 1 is an explanatory diagram illustrating in detail the waste toner container 52 (waste toner storing section) and the waste toner amount detecting section provided in the image forming apparatus shown in FIG. 3. As shown in FIG. 1, a base 54 is fixed to a frame 57 of the image forming apparatus for restricting the mounting position of the waste toner container 52 with respect to the image forming apparatus. The base 54 has an upwardly concaved shape having side walls which laterally restrict the position of the waste toner container 52. The base 54 further has a rear side wall (not shown) located on the rear side for restricting the stop position of the waste toner container 54 when the waste toner container 52 is inserted from the front side to the innermost position in the image forming apparatus. With the waste toner container 52 fully inserted in the normal mounting position, a toner receiving port 53 provided in an upper portion of the waste toner container 52 is located just below the end of the waste toner transport path 51. The waste toner transported through the waste toner transport path 51 and falling from the end of the waste toner transport path 51 is accumulated in the waste toner container 52 through the toner receiving port 53.

A mechanism for engaging the end of the waste toner transport path 51 with the toner receiving port 53 of the waste toner container 52 in the normal mounting position may be provided. Further, the waste toner container 52 may include a shutter mechanism which covers an opening of the toner receiving port 53 for prevention of leak of the inside toner when the waste toner container 52 is taken out of the image forming apparatus. Although various specific arrangements for these mechanisms are conceivable, those skilled in the art can easily design these mechanisms. These mechanisms are not essential to the present invention and, therefore, will not be described in further detail.

An energization electrode 56 is provided in the waste toner container 52. The surface of the energization electrode 56 is partly exposed to be brought into contact with the waste toner accumulated in the waste toner container 52. The energization electrode 56 is located at a position lower than a detection electrode 571 which detects the amount of the waste toner accumulated to the lowest detection level. The energization electrode 56 may be provided, for example, on the bottom of the waste toner container 52.

The energization electrode 56 is connected to one of the terminals of the connector (not shown) provided in the rear side wall of the waste toner container 52. With the waste toner container 52 set in the aforesaid normal mounting position, the terminal is engaged with a corresponding one of the terminals provided on the side of the image forming apparatus body. The energization electrode 56 is connected to an output of a detection power source 55 provided on the side of the image forming apparatus through the engaged terminals. The detection power source 55 applies a DC voltage to the energization electrode 56, and the output is, for example, a DC voltage of 700V. The output is not limited to the DC voltage, but may be an AC voltage or have a different voltage level.

In the waste toner container 52, six detection electrodes 571 to 576 are provided in opposed relation to the energization electrode 56. The detection electrodes 571 to 576 are located at different heights which respectively correspond to different waste toner accumulation heights to be detected or different waste toner detection levels.

The detection electrodes 571 to 576 are respectively connected to corresponding ones of the terminals of the connector (not shown) provided in the rear side wall of the waste toner container 52. With the waste toner container 52 set in the aforesaid normal mounting position, the terminals of the connector are respectively engaged with the corresponding terminals provided on the side of the image forming apparatus body. Electrode current detecting sections 581 to 586 provided on the side of the image forming apparatus are grounded through the engaged terminals.

The surfaces of the detection electrodes 571 to 576 are partly exposed to be brought into contact with the waste toner accumulated in the waste toner container 52. Where the waste toner container 52 is empty, the detection electrodes 571 to 576 are opposed to the energization electrode 56 with the intervention of air. Even with the voltage being applied to the energization electrode 56 from the detection power source 55, electrical connection between the energization electrode 56 and any of the detection electrodes 571 to 576 is not established, so that no electric current flows through any of the detection electrodes. The waste toner container 52 is composed of an insulative resin, so that the energization electrode 56 is electrically isolated from the detection electrodes 571 to 576. When the waste toner is accumulated in the waste toner container 52 to reach the level of the detection electrode 571, a space between the energization electrode 56 and the detection electrode 571 is filled with the waste toner. Therefore, a minute electric current flows between the energization electrode 56 and the detection electrode 571. In general, the toner is regarded as an insulator. The toner has a resistivity of about $10^{12}$ to about $10^{14}$ which is relatively low among other insulators, though substances having resistivity levels in this range are classified as insulators. Therefore, a voltage of about 700V is applied to the energization electrode 56 to cause a detectable minute electric current to flow through the detection electrode 571. The level of the electric current depends upon the distance between the energization electrode 56 and the detection electrode 571, the density of the waste toner and the shape of the waste toner container which influences an effective sectional area defined between these electrodes. Where the electric current flowing through the detection electrode 571 is on the order of several tens microamperes, for example, the electrode current detecting section 581 is constituted by a current detection resistor and a differential amplifier which detects a potential difference occurring between opposite ends of the resistor when the current flows. An output voltage of the differential amplifier is digitally converted by an A/D converter, whereby the microprocessor of the control board detects the current flowing through the detection electrode 571. The electrode current detecting sections 582 to 586 for the respective detection electrodes 572 to 576 each have the same construction as the electrode current detecting section 581.

The electric current flowing through the detection electrode 571 is detected by the corresponding electrode current detecting section 581. The energization electrode 56 is still isolated from the other detection electrodes 572 to 576 by air, so that virtually no electric current flows through the detection electrodes 572 to 576.

Detection signals of the electrode current detecting sections 581 to 586 are inputted to the control board. The microprocessor detects the results of the detection by the electrode current detecting sections 581 to 586. That is, the microprocessor detects a state in which the electric current flows only through the detection electrode 571 and no electric current flows through the detection electrodes 572 to 576. This state corresponds to the lowest detection level for the detection of the waste toner amount.

When the waste toner is further accumulated to reach the detection electrode 572, the electric current also flows through the detection electrode 572. This state corresponds to the second lowest detection level for the detection of the waste toner amount. Similarly, the electric current flows through the detection electrodes 573, 574, 575 and 576 in this order, as the waste toner accumulation amount is increased.

When the waste toner is further accumulated to reach the detection electrode 576, the electric current also flows through the detection electrode 576. This state is detected as the highest detection level for the detection of the waste toner amount, meaning that the waste toner container 52 becomes full. If the waste toner was further accumulated in the waste toner container 52, the waste toner would overflow through the toner receiving port 53 into the waste toner transport path 51, thereby clogging the waste toner transport path 51. Therefore, when the electric current flows through the detection electrode 576 which corresponds to the full capacity level, the microprocessor controls the image forming apparatus to interrupt the printing job so as to prevent further removal of the waste toner.

Number of Detection Levels and Intervals Between Detection Levels

In this embodiment, as described above, the six detection electrodes are provided to detect the waste toner amount on the basis of six detection levels. However, the number of the detection levels is not limited to six, but is preferred to be not less than three.

Here, a level difference between the detection electrodes 571 and 572 is indicated by d1. Level differences between the detection electrodes 572 and 573, between the detection electrodes 573 and 574, between the detection electrodes 574 and 575 and between the detection electrodes 575 and 576 are respectively indicated by d2, d3, d4 and d5. In this embodiment, the level differences satisfy the following relation: d1=d2=d3, d4=d5 and d3>d5. That is, an interval (equivalent to the level difference d5) between the highest detection level for the greatest waste toner amount and the second highest detection level is equal to an interval (equivalent to the level difference d4) between the second highest detection level and the third highest detection level, but smaller than intervals (equivalent to the level differences d3, d2, d1) between the lower detection levels for the smaller waste toner amounts. In other words, the intervals between the detection levels are each set to either of two different values, and the intervals between the detection levels for the greater waste toner amounts are equal to or smaller than the intervals between the detection levels for the smaller waste toner amounts.

In this embodiment, the level differences (intervals) d1 to d3 are set to a first value, and the level differences (intervals) d4 and d5 are set to a second value. However, the number of the level difference values is not limited to two, but may be more than two.

Figure 4:
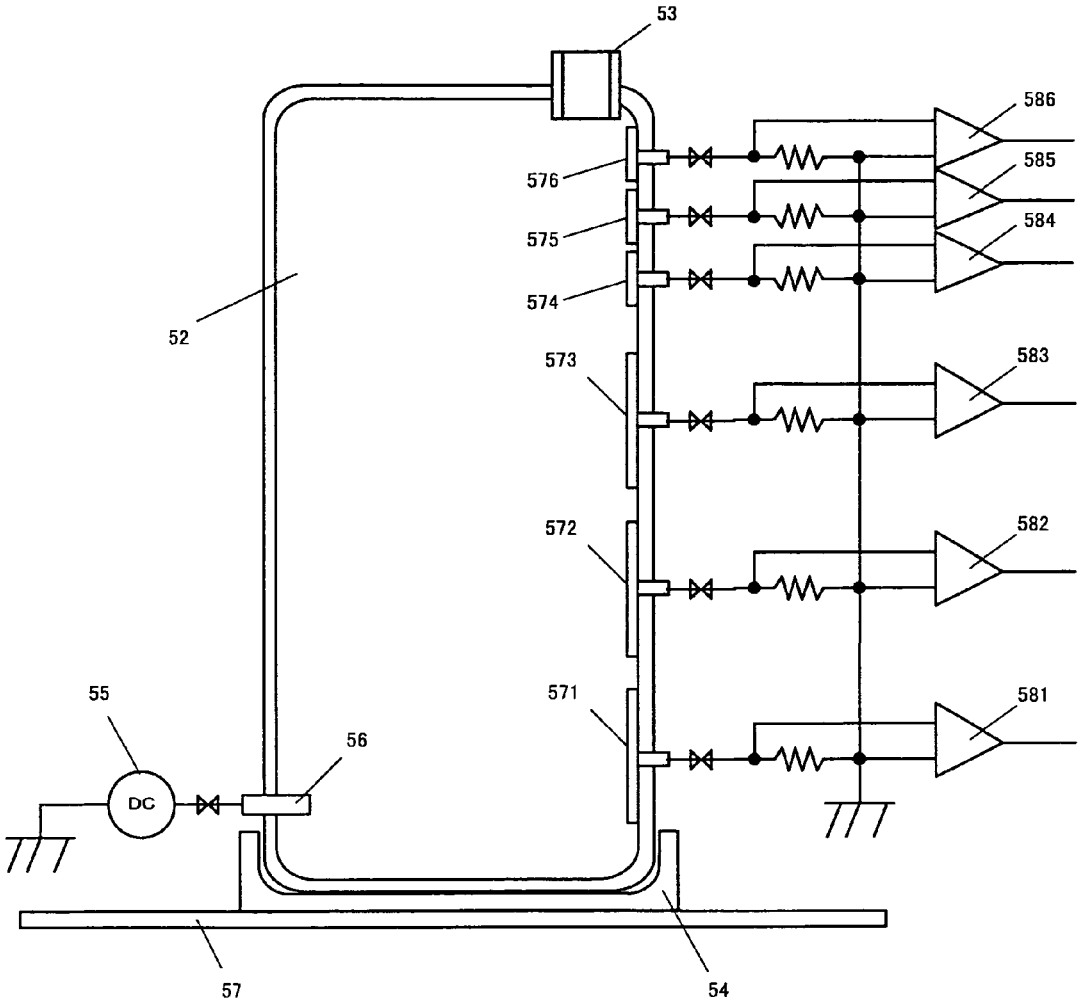
FIG. 4 is an explanatory diagram illustrating an arrangement for an energization electrode and detection electrodes which is different from the arrangement shown in FIG. 1.

An alternative arrangement for the energization electrode 56 and the detection electrodes 571 to 576 is as follows. FIG. 4 is an explanatory diagram illustrating the arrangement for the energization electrode and the detection electrodes which is different from the arrangement shown in FIG. 1. In FIG. 4, the energization electrode 56 is disposed on one side wall of the waste toner container 52, and the detection electrodes 571 to 576 are disposed in a side wall opposed to the one side wall. The detection electrodes 571 to 576 each have a greater surface area, so that a greater electric current flows through the detection electrodes 571 to 576.

Process to be Performed According to Waste Toner Amount

In this embodiment, the microprocessor detects the waste toner amount on the basis of the plurality of the detection levels, and performs the following control operation according to the detected waste toner amount. Before performing a printing job, the microprocessor estimates the amount of waste toner to be accumulated in the waste toner container 52 during the printing job. For example, the maximum amount of the waste toner to be stored in the waste toner container 52 is typically about 5 kg by weight. It is herein assumed that the standard amount of the toner to be used for printing an image on an A4-size sheet is 1.5 g. The amount of the waste toner to be stored when the printing operation is performed on 8000 A4-size sheets contained in the large volume sheet cassette 81 in the image forming apparatus shown in FIG. 3 is as follows. Here, the toner transfer efficiency is assumed to be 80%.

$$\begin{aligned}\text{Waste toner amount} &= 1.5 \times (100 - 80)/100 \times 8000 \\ &= 2400\ (\text{g}) \\ &= 2.4\ (\text{kg})\end{aligned}$$

If the printing job is a large volume printing job such that the sheets congained in the large volume sheet cassette 81 are used up, the amount of the waste toner to be stored in the waste toner container 52 during the printing job is equivalent to about a half of the capacity of the waste toner container 52. If such a large volume printing job is frequently performed, the waste toner container 52 is inrewased. However, if the capacity of the waste toner container 52 is greater than 5 Kg, it is difficult for the user to handle the waste toner container 52 for the mounting/demounting and replacement of the wast toner container 52.

In the case of the high speed image forming apparatus which is required to efficiently perform the large volume printing job, as described above, the interruption of the printing job is desirably avoided as much as possible. In this connection, it is preferred to perform the control operation so as to prevent the waste toner container 52 from being filled to capacity during the printing job. To this end, it is preferred to provide a warning for prompting the user to replace the waste toner container 52 when the user inputs a command for starting the printing job. Immediately after inputting the printing job start command, the user is most likely to check a message displayed on an operation screen. Upon viewing the displayed message, the user will immediately replace the waste toner container. Once starting the printing job, the user and the other people are unlikely to be present around the image forming apparatus. Particularly, the large volume printing job is time-consuming, so that the user is likely to walk away from the image forming apparatus or divert attention from the operation screen. Therefore, even if the full capacity state of the waste toner container is detected during the printing job, the user is unlikely to immediately perform the necessary operation, so that the printing job will be left interrupted. On the other hand, if the warning for the replacement of the waste toner container is provided before the start of the printing job even with the waste toner container 52 having a sufficient residual capacity, the frequency of the warning for the replacement of the waste toner container is needlessly increased. This may result in complaints from users.

To solve this problem, the control operation for the detection of the waste toner amount and the warning is performed in the following manner in the image forming apparatus according to this embodiment. The microprocessor detects the amount of the waste toner accumulated in the waste toner container 52 before the waste toner container 52 becomes full. On the basis of the detected waste toner amount and the amount of the waste toner to be accumulated in the waste toner container during the printing job, the microprocessor judges whether or not the warning for the replacement of the waste toner container is to be provided when receiving the printing job start command. By thus performing the control operation, the replacement of the waste toner container 52 is not needlessly carried out. In addition, the possibility that the printing job is interrupted due to the full capacity state of the waste toner container is reduced. This is advantageous for the user.

Next, a consideration is given to a case where the waste toner is accumulated to the near capacity level in the waste toner container by repeatedly performing small volume printing jobs rather than by performing the large volume printing job such that all the sheets contained in the cassette are used up. In this case, it is preferred to accurately detect the amount of the waste toner currently accumulated in the waste toner container 52 and to accurately predict whether or not the waste toner container 52 is to be filled to the full capacity level during the printing job. As for the number of pages to be printed until the waste toner container 52 is filled to the full capacity level, a printable page number estimated before the start of the printing job has a smaller absolute error when the waste toner container 52 has a smaller residual capacity than when the waste toner container 52 has a greater residual capacity. Since the absolute value of the estimated printable page number is smaller, the absolute value of the error is also smaller. The error firstly depends upon the accuracy in the detection of the residual capacity of the waste toner container, i.e., the fineness of the scale of the detection levels, secondly upon a difference between an actual printing area ratio per page and a reference printing area ratio per page to be used for the prediction, and thirdly upon variations in the degree of fogging due to the fatigue of the photoconductor drum and ambient conditions. Therefore, it is preferred to accurately detect the amount of the waste toner accumulated in the waste toner container 52 for the accurate prediction. That is, the detection levels are finely defined. This is why the level differences d5, d4 are smaller than the level differences d1 to d3 as shown in FIG. 1.

If the level differences d1 to d3 are set smaller to be equivalent to the level difference d5 (or d4), the number of the detection electrodes should be increased to cover the same detection range. However, the error in the prediction occurs depending on the printing area ratio and the degree of the fogging, so that the detection accuracy cannot be necessarily increased by increasing the number of the detection electrodes. Therefore, the interval between the detection levels for the detection of the near capacity state is preferably smaller than the interval between the detection levels for the detection of a near empty state.

Figure 5:
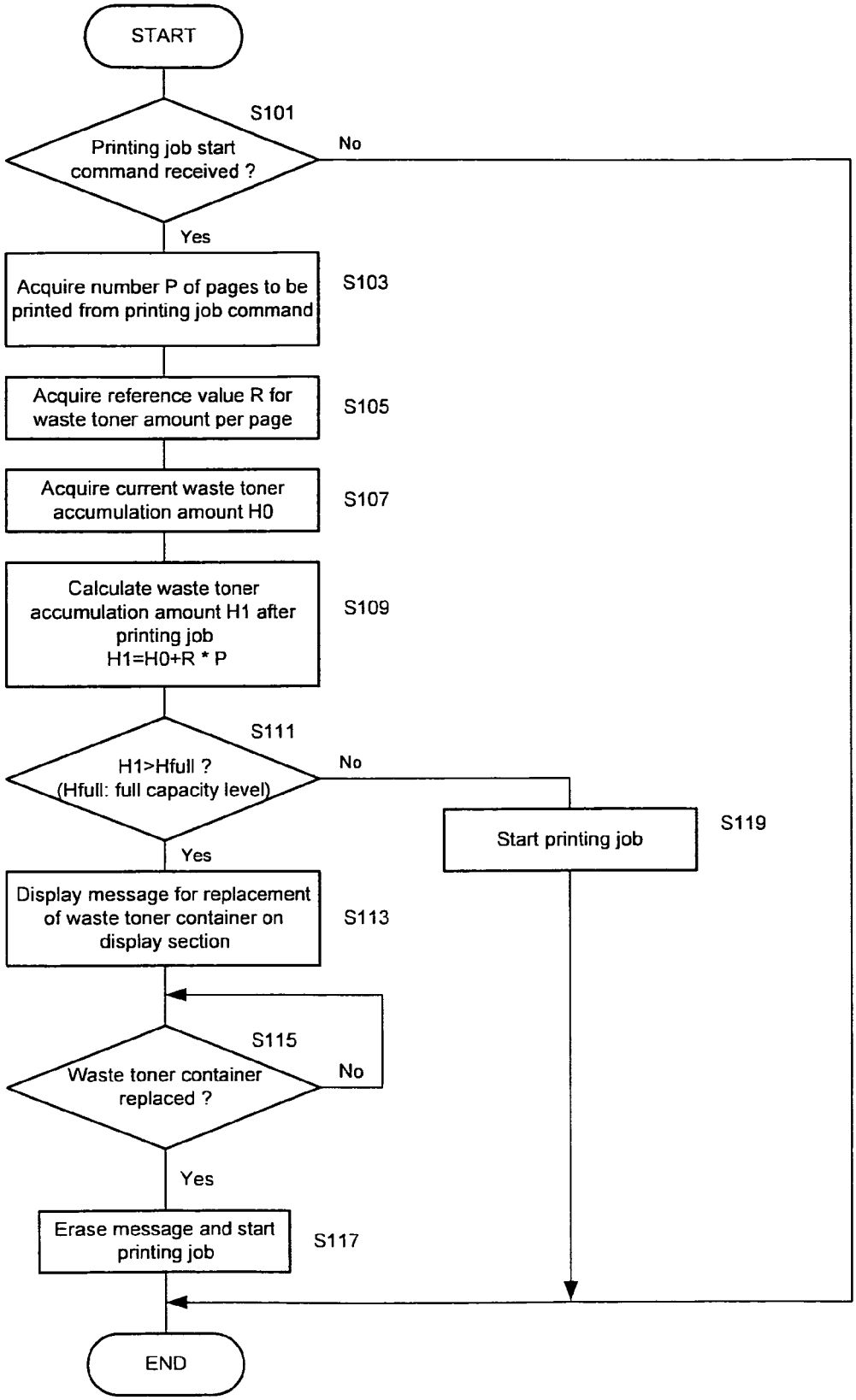
FIG. 5 is a flow chart according to an example method of the present invention showing a process to be performed for determining whether or not a warning is to be provided on the basis of the result of detection of a waste toner amount and printing job information when a job starting command is received.

FIG. 5 is a flow chart showing a process to be performed by the microprocessor for determining whether or not the warning is to be provided for requesting the replacement of the waste toner container when the printing job start command is received. The microprocessor provides the warning on the basis of the result of the detection of the waste toner amount in the waste toner container 52 and the received printing job information. As shown in FIG. 5, the microprocessor receives the printing job start command (Step S101), and acquires the number of pages P to be printed in the printing job from the received printing job information (Step S103).

Further, the microprocessor acquires a reference value R which is defined as a waste toner storage amount per page (Step S105). The reference value R may be a predetermined value stored in a predetermined ROM, or a value determined on the basis of the number of pages previously printed by the image transfer and the history of the waste toner amount detected by the waste toner amount detecting section during the printing. The reference value R may be retained in the nonvolatile memory on the control board. By properly selecting the period of the history, for example, a difference in the waste toner storage amount per page between a case where the fogging is remarkable due to degradation of the photoconductor drum and a case where the fogging is negligible. Therefore, the waste toner storage amount per page can be more accurately estimated according to the state of the image forming apparatus.

In turn, the microprocessor acquires a current waste toner accumulation amount H0 (Step S107). The current waste toner accumulation amount H0 is determined on the basis of the six detection levels by the results of the detection by the electrode current detecting sections 581 to 586. A waste toner accumulation amount H1 after the printing job started in response to the reception of the start command is estimated through calculation of the following expression (Step S109):

$$H1=H0+R\times P$$

Then, whether or not the estimated waste toner accumulation amount H1 exceeds the capacity of the waste toner container 52 is judged (Step S111). If the estimated waste toner accumulation amount H1 does not exceed the capacity, the printing job is started (Step S119). If the estimated waste toner accumulation amount H1 exceeds the capacity, the warning message for prompting the user to replace the waste toner container 52 is displayed on the display section, and the image forming apparatus is brought into a standby state (Step S113).

When the microprocessor detects the replacement of the waste toner container 52 (Step S115), the message is erased and the printing job is started (Step S117). The replacement of the waste toner container 52 is detected by the microprocessor, for example, on the basis of the detachment and attachment of the connector (not shown) provided in the rear side wall of the waste toner container 52.

If the microprocessor judges that the user is present in the vicinity of the image forming apparatus when the waste toner container is filled to the full capacity level or to the near capacity level, the microprocessor displays the warning message on the operation panel (not shown) for requesting the replacement of the waste toner container 52. The warning message may be displayed, for example, in the form of a pop-up message on the display screen of the operation panel, and erased when the detachment and attachment of the waste toner container 52 by the user is detected. In this case, if the printing job is performed, a currently performed printing operation is completed and then the printing job is interrupted for preventing the clogging of the waste toner transport path 51. Then, the replacement of the waste toner container 52 is requested as a highly urgent operation. Therefore, the restart of the printing job may be prevented until the pop-up message is erased. The pop-up message for requesting the highly urgent operation may be displayed only when the user is present in the vicinity of the image forming apparatus. Judgment on whether or not the user is present in the vicinity of the image forming apparatus may be based, for example, on operation of any keys on the operation panel, replenishment of the sheet feeding tray 8 with sheets or removal of sheets from the sheet receiving tray 9.

Alternatively, the pop-up message may be displayed in response to any other events requiring user's action. Examples of these events include a paper jam, a paper-out state of the sheet feeding tray 8 and a full capacity state of the sheet receiving tray 9. When the printing job is interrupted due to any of these events, the user is expected to come to the vicinity of the image forming apparatus for performing a restoration operation. At this time, the user replaces the waste toner container 52.

Figure 6:
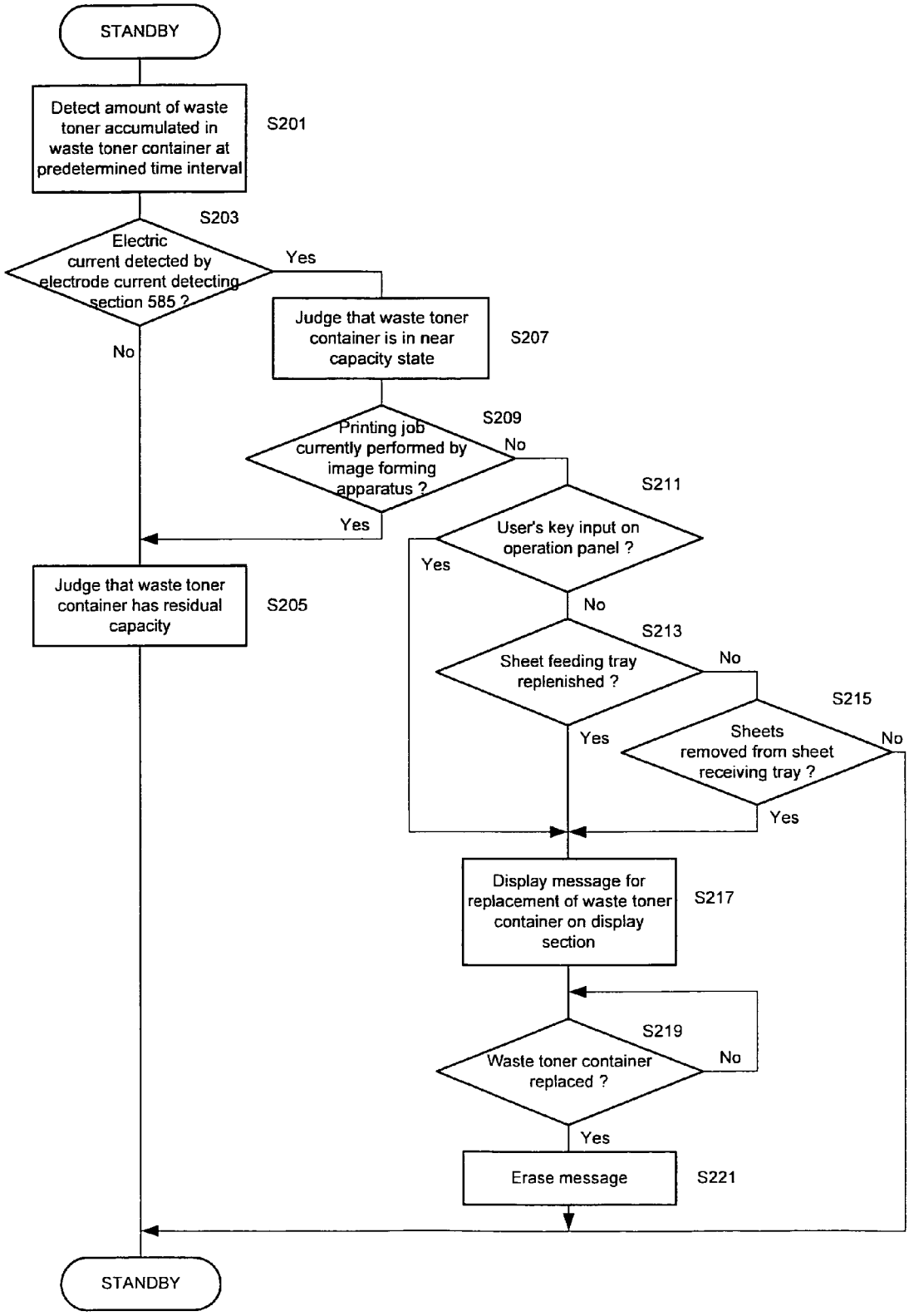
FIG. 6 is a flow chart according to an example method of the present invention showing an exemplary process to be performed by a microprocessor for displaying a warning message when a near capacity state of the waste toner container is detected.

FIG. 6 is a flow chart showing an exemplary process to be performed by the microprocessor for displaying a warning message when the near capacity state of the waste toner container 52 is detected. As shown in FIG. 6, the microprocessor detects the amount of the waste toner accumulated in the waste toner container 52 at a predetermined time interval (Step S201). The waste toner amount is detected on the basis of the waste toner detection levels, for example, by turning on the detection power source 55 shown in FIG. 4 to output a voltage, applying the voltage to the energization electrode 56, and determining whether or not the electric current flows through the detection electrodes 571 to 576 on the basis of the results of the detection by the electrode current detecting sections 581 to 586.

If the electric current flows through the detection electrode 575, for example, the microprocessor judges that the waste toner container 52 is in the near capacity state, and displays the warning message only when the user is present in the vicinity of the image forming apparatus. Therefore, the microprocessor judges whether or not the electrode current detecting section 585 detects the electric current (Step S203). If the electrode current detecting section 585 does not detect the electric current, the microprocessor judges that the waste toner container 52 has a sufficient residual capacity (Step S205), and awaits the next waste toner amount detecting operation.

On the other hand, if the electrode current detecting section 585 detects the electric current, the microprocessor judges that the waste toner container 52 is in the near capacity state (Step S207), and judges whether the image forming apparatus is currently in the standby state or performs the printing job (Step S209). If the printing job is currently performed, the microprocessor judges that the waste toner container 52 has a residual capacity (Step S205), and awaits the next waste toner amount detecting operation. During the printing job, the image forming apparatus is controlled so that the printing operation is stopped when the waste toner container is in the full capacity state rather than in the near capacity state.

If it is judged in Step S209 that the printing job is not currently performed, the microprocessor judges whether or not there is a key input on the operation screen (Step S211). If there is a key input, the routine goes to Step S217 to be described later. If there is no key input, the microprocessor judges whether or not the sheet feeding tray 8 is replenished with sheets (Step S213). If the sheet feeding tray 8 is replenished, the routine goes to Step S217 to be described later. If the sheet feeding tray 8 is not replenished, the microprocessor judges whether or not sheets are removed from the sheet receiving tray 9 (Step S215). If the sheets are not removed from the sheet receiving tray 9, the routine ends, and the microprocessor awaits the next waste toner amount detecting operation.

On the other hand, if it is judged that the sheets are removed from the sheet receiving tray 9, that there is the key input on the operation screen or that the sheet feeding tray 8 is replenished with sheets, the routine goes to Step S217, and the message for requesting the replacement of the waste toner container 52 is displayed on the display section. Then, the microprocessor awaits detection of the replacement of the waste toner container 52 (Step S219). Upon the replacement of the waste toner container 52, the microprocessor erases the message (Step S221), and awaits the next waste toner amount detecting operation. Here, the routine is looped when the microprocessor awaits the replacement of the waste toner container 52 for easy understanding of the process flow. In actual control software, however, the microprocessor monitors the replacement of the waste toner container 52 in a polling routine and erases the message so as to permit other processes during the looping.

Obviously, various modifications are possible in addition to the embodiments described above. It should be understood that such modifications also fall within the aspects and scope of the present invention. The present invention is intended to embrace all alterations made within the scope of the invention defined by the appended claims and their equivalents.

What is claimed is:

1. An image forming apparatus arranged to execute an image forming process on a page by page basis, comprising:

a toner image forming section arranged to produce a visible image formed of toner as a toner image on an image carrier;

a transfer section arranged to perform a transfer process to transfer the formed toner image onto a recording medium;

a cleaning section arranged to remove toner remaining on the image carrier after the transfer section performs the transfer process;

a waste toner storing section arranged to accumulate the removed toner; and a waste toner amount detecting section arranged to detect an amount of the toner accumulated in the waste toner storing section on the basis of a plurality of detection levels where each detection level is distinct from other detection levels, wherein an interval between highest two successive detection levels is less than an interval between lowest two successive detection levels.

2. An image forming apparatus of claim 1, wherein the waste toner amount detecting section includes:

an energization electrode provided at a height lower than a height associated with the lowest detection level in the waste toner storing section;

a plurality of detection electrodes respectively provided at heights associated with the plurality of detection levels in opposed relation to the energization electrode in the waste toner storing section;

a detection power source arranged to apply a predetermined voltage between the energization electrode and each of the detection electrodes; and an electrode current detecting section arranged to detect, when the toner is accumulated to a level higher than each of the detection electrodes, an electric current flowing between the detection electrode and the energization electrode through the toner.

3. An image forming apparatus of claim 1, further comprising:

a printing page number acquiring section arranged to acquire a number of pages to be printed through the image forming process before the image forming process is started;

a waste toner amount estimating section arranged to estimate an amount of the toner to be accumulated in the waste toner storing section during the image forming process; and a warning controlling section arranged to provide, if it is predicted that the waste toner storing section becomes full during the image forming process after the start of the image forming process on the basis of the estimated toner amount and the toner amount detected by the waste toner amount detecting section, a warning to request a discard of the waste toner before start of a printing operation in the image forming process.

4. An image forming apparatus of claim 3, wherein the waste toner estimating section is arranged to determine a waste toner amount per page on the basis of a number of pages previously printed by the image transfer in the transfer section and a history of the toner amount previously detected by the waste toner amount detecting section, and to estimate the amount of the toner to be accumulated in the waste toner storing section during the image forming process on the basis of the determined waste toner amount per page and the number of the pages to be printed through the image forming process.

5. An image forming apparatus of claim 1, further comprising a warning controlling section arranged to provide, when the waste toner amount detecting section determines that the toner accumulated in the waste toner storing section reaches the highest detection level or a level lower by a predetermined amount than the highest detection level, a warning to request a discard of the waste toner in response to an operation performed on the image forming apparatus by a user.

6. An image forming apparatus of claim 5, further comprising an operation panel arranged to receive an input of a command to start a copier image forming process, wherein the warning controlling section provides the warning in response to the input of the command to start the image forming process via the operation panel.

7. An image forming apparatus of claim 5, further comprising an operation panel arranged to receive an input of a command to start a facsimile transmitting process, wherein the warning controlling section provides the warning in response to the input of the command to start the facsimile transmitting process via the operation panel.

8. An image forming apparatus of claim 5, further comprising:

a recording medium outputting section arranged to output the recording medium outside the apparatus after the image transfer;

a recording medium receiving section arranged to receive the outputted recording medium; and a recording medium removal detecting section arranged to detect a removal of the recording medium from the recording medium receiving section by the user, wherein the warning controlling section provides the warning in response to the detection of the removal of the recording medium by the recording medium removal detecting section as the operation.

9. An image forming apparatus of claim 5, further comprising:

a recording medium feeding section arranged to feed the recording medium to the transfer section;

a recording medium feed tray arranged to accommodate the recording medium to be fed; and a recording medium replenishment detecting section arranged to detect a replenishment of the recording medium feed tray with recording media by the user, wherein the warning controlling section provides the warning in response to the detection of the replenishment of the recording medium feed tray with the recording media by the recording medium replenishment detecting section as the operation.

10. An image forming apparatus of claim 1, further comprising a warning controlling section arranged to provide, when the waste toner amount detecting section determines that the toner is accumulated to a full capacity level or a near capacity level in the waste toner storing section, a warning to request a discard of the waste toner in response to an event which requires a user to perform an operation on the image forming apparatus.

11. An image forming apparatus of claim 10, further comprising a jam detecting section arranged to detect a jam of the recording medium, wherein the warning controlling section provides the warning in response to the detection of the jam by the jam detecting section as the event.

12. An image forming apparatus of claim 10, further comprising:

a recording medium feeding section arranged to feed the recording medium to the transfer section;

a recording medium feed tray arranged to accommodate the recording medium to be fed; and an emptiness detecting section arranged to detect an emptiness of the recording medium feed tray, wherein the warning controlling section provides the warning in response to the detection of the emptiness of the recording medium feed tray by the emptiness detecting section as the event.

13. An image forming apparatus of claim 10, further comprising:

a recording medium outputting section arranged to output the recording medium after the image transfer;

a recording medium receiving section arranged to receive the outputted recording medium; and a full capacity state detecting section arranged to detect a full capacity state of the recording medium receiving section, wherein the warning controlling section provides the warning in response to the detection of the full capacity state of the recording medium receiving section by the full capacity state detecting section as the event.

14. An image forming apparatus of claim 1, wherein an interval between any higher two successive detection levels is less than or equal to an interval between any lower two successive detection levels.

15. An image forming apparatus of claim 1, wherein an interval between any higher two successive detection levels is less than an interval between any lower two successive detection levels.

16. A waste toner warning method, for use in an image forming apparatus arranged to execute an image forming process on a page by page basis including a developing section arranged to produce a visible image formed of toner as a toner image on an image carrier, a transfer section arranged to perform a transfer process to transfer the formed toner image onto a recording medium, a cleaning section arranged to remove toner remaining on the image carrier after the transfer process, and a waste toner storing section arranged to accumulate the removed toner to provide a warning on the basis of detection of an amount of the toner accumulated in the waste toner storing section, the method comprising:

detecting the amount of the accumulated toner on the basis of at least three detection levels;

before an image forming process is started, estimating an amount of the toner to be accumulated in the waste toner storing section during the image forming process; and if it is predicted that the waste toner storing section becomes full during the image forming process after the start of the image forming process on the basis of the estimated toner amount and a detection result obtained in the toner amount detecting step, providing a warning to request a discard of the waste toner before the start of the image forming process.

17. A waste toner warning method of claim 16, wherein an interval between highest two successive detection levels is less than an interval between lowest two successive detection levels.

18. A waste toner warning method of claim 17, wherein an interval between any higher two successive detection levels is less than or equal to an interval between any lower two successive detection levels.

19. A waste toner warning method of claim 17, wherein an interval between any higher two successive detection levels is less than an interval between any lower two successive detection levels.

* * * * *